US012486746B2

(12) United States Patent
Brooks

(10) Patent No.: US 12,486,746 B2
(45) Date of Patent: Dec. 2, 2025

(54) SCREEN-OUT FLOW DEVICE AND PROCESS

(71) Applicant: Matthew Joseph Brooks, Calgary (CA)

(72) Inventor: Matthew Joseph Brooks, Calgary (CA)

( * ) Notice: Subject to any disclaimer, the term of this patent is extended or adjusted under 35 U.S.C. 154(b) by 0 days.

(21) Appl. No.: 18/818,967

(22) Filed: Aug. 29, 2024

(65) Prior Publication Data

US 2025/0075603 A1 Mar. 6, 2025

Related U.S. Application Data

(60) Provisional application No. 63/536,779, filed on Sep. 6, 2023.

(51) Int. Cl.
*E21B 43/26* (2006.01)
*E21B 34/14* (2006.01)
*E21B 43/12* (2006.01)

(52) U.S. Cl.
CPC ..... *E21B 43/26* (2013.01); *E21B 34/142* (2020.05); *E21B 43/12* (2013.01); *E21B 2200/06* (2020.05)

(58) Field of Classification Search
CPC ..... E21B 43/26; E21B 34/142; E21B 43/12; E21B 2200/06
See application file for complete search history.

(56) References Cited

U.S. PATENT DOCUMENTS 7,090,020 B2 * 8/2006 Hill ..... E21B 33/124 166/373
7,735,559 B2 * 6/2010 Malone ..... E21B 43/12 166/227
8,869,898 B2 * 10/2014 Xu ..... E21B 34/14 166/305.1
9,316,084 B2 * 4/2016 Carter ..... E21B 34/142
9,416,643 B2 * 8/2016 Purkis ..... E21B 43/26
10,030,473 B2 7/2018 Tolman
10,125,573 B2 * 11/2018 Flores Perez ..... E21B 34/14
10,138,707 B2 11/2018 Tolman
11,788,385 B2 * 10/2023 Hamid ..... E21B 43/088 166/250.01
11,808,106 B2 * 11/2023 Wood ..... E21B 33/1204
11,859,483 B2 * 1/2024 Brooks ..... E21B 23/06
12,037,867 B2 * 7/2024 Fripp ..... E21B 43/26
12,104,461 B2 * 10/2024 Macphail ..... E21B 43/12
2013/0048301 A1 * 2/2013 Gano ..... E21B 34/08 166/321
2013/0056220 A1 * 3/2013 Sommers ..... E21B 34/102 166/334.1
2014/0041876 A1 * 2/2014 Fleckenstein ..... E21B 43/14 166/329

(Continued)

*Primary Examiner* — Aaron L Lembo

(74) *Attorney, Agent, or Firm* — NGUYEN TARBET IP LAW

(57) ABSTRACT

A process for generating fluid flow out of a first fracture zone of a well including a liner or casing is described. The process is engaged to remove a screen-out condition and/or to protect downhole tools deployed in the well and includes the steps of providing the casing with a fluid flow pathway extending from a first fracture zone to an adjacent fracture zone downhole from the first fracture zone. The fluid flow pathway becomes operable when a pre-determined parameter is reached as a result of the screen-out condition. A device for providing the fluid flow pathway is also described.

20 Claims, 9 Drawing Sheets

(56) References Cited

U.S. PATENT DOCUMENTS

| | | | | |
|---|---|---|---|---|
| 2014/0096963 | A1* | 4/2014 | Sharma | E21B 33/13 166/278 |
| 2015/0068762 | A1* | 3/2015 | Naedler | E21B 43/267 166/373 |
| 2015/0075785 | A1* | 3/2015 | Brekke | E21B 34/14 166/250.01 |
| 2016/0061011 | A1* | 3/2016 | Ireland | E21B 43/04 166/241.1 |
| 2016/0084075 | A1* | 3/2016 | Ingraham | E21B 23/01 166/53 |
| 2017/0138150 | A1* | 5/2017 | Yencho | E21B 43/14 |
| 2018/0094508 | A1* | 4/2018 | Smith | E21B 43/26 |
| 2021/0087908 | A1* | 3/2021 | Novelen | E21B 34/063 |
| 2021/0148206 | A1* | 5/2021 | Wages | E21B 34/14 |
| 2022/0251934 | A1* | 8/2022 | Gibson | E21B 34/142 |
| 2022/0282597 | A1* | 9/2022 | Hamid | E21B 49/087 |

* cited by examiner

SCREEN-OUT FLOW DEVICE AND PROCESS

CROSS-REFERENCE TO RELATED APPLICATIONS

This application claims the benefit of priority to U.S. Provisional Application No. 63/536,779 filed on Sep. 6, 2023, which is incorporated herein by reference in its entirety.

TECHNICAL FIELD

The invention relates to hydraulic fracturing in hydrocarbon extraction and more particularly to a device and process for addressing the problem of screen-outs where sand and other materials cause blockages in fractures and prevent efficient extraction of hydrocarbons.

BACKGROUND

Hydraulic fracturing is a technique used to extract hydrocarbons from underground rock formations. This technique involves injecting a high-pressure fluid mixture into an isolated zone of a wellbore to create fractures in the rock. These fractures allow the trapped hydrocarbons to flow more freely, increasing the production rates.

During the hydraulic fracturing process, proppants are commonly added to the fluid. Proppants, such as sand or ceramic beads, are solid materials that help keep the fractures open once the pressure is released.

In the context of hydraulic fracturing operations, the term "screen-outs" refers to a problem that can occur during the fracturing process. A screen-out occurs when the proppant or other solid materials used in the fracturing fluid fail to flow down the fracture and accumulate and block the fractures. If the situation is not alleviated, then pumping pressures may begin to increase and may lead to a premature shutdown of the job leaving proppant in the wellbore. To continue the fracturing process or to begin production from the well, the proppant that was left in the wellbore will either have to be flowed to surface or cleaned out by use of mechanical means.

Screen-outs can happen due to several factors, such as (i) inadequate fracture design which causes excessive proppant accumulation at certain points, (ii) excessive fracturing pressure which causes reduced pump rates, making it easier for proppants to become trapped, (iii) insufficient fluid carrying capacity, which can cause settling of the proppant, and (iv) the geology and properties of the rock formation being fractured can have complex or unpredictable fracture networks which may be more prone to proppant accumulation and blockages. These are common factors causing screen-outs. Other factors may contribute to development of screen-outs.

Screen-outs can have significant consequences for hydraulic fracturing operations. They can reduce the efficiency of the wellbore completions operations, lower production rates by having incomplete fracture jobs, and increase costs by inducing unplanned work. Screen-outs can also cause excessive downhole pressure that has the potential to damage downhole tools, which once damaged, can never be repaired and may lead to the loss of a potentially productive reservoir. Resolving screen-outs typically involves performing remedial operations, such as attempting to flow the blockage to surface using the energy of the well, failing that, using coiled tubing or other tools to remove the accumulated proppants or attempting to open the blocked fractures through various techniques.

To mitigate the risk of screen-outs, engineers and operators employ advanced fracture modeling, data analysis, and monitoring techniques. By optimizing fracture designs, adjusting fluid properties, and monitoring the injection process in real-time, they aim to minimize the occurrence of screen-outs and maximize the productivity of hydraulic fracturing operations.

Despite these efforts to mitigate the risk of screen-outs, unpredictability of factors contributing to screen-outs require other solutions to address screen-outs when they occur. Some examples of remediation of screen-outs are described in U.S. Pat. Nos. 10,030,473 and 10,138,707, each of which is incorporated herein by reference in its entirety.

There remains a need for practical improvements in addressing the problem of screen-outs occurring during hydraulic fracturing operations. A need exists also to protect the integrity of downhole tools during the fracturing process, not only during screen-out conditions but also during normal operations. This may be for example to maintain acceptable pressure differentials across packers or to avoid casing collapse scenarios. A need also exists to maintain the integrity of isolating media between fractured intervals. In the case of closable fracture valves, if the media isolating flow and pressure between fractured intervals is compromised, and the decision is taken to close a valve for example, to shut off water production, then the water has the potential to find a flow path to an adjacent open frac valve.

SUMMARY

In accordance with one embodiment of the present disclosure, there is provided a process for generating fluid flow out of a first fracture zone of a well including a liner or casing to remove a screen-out condition and/or to protect one or more downhole tools deployed in the well. The process comprises the steps of providing the casing with a permanent or temporary fluid flow pathway extending from a first fracture zone to an adjacent fracture zone downhole from the first fracture zone, wherein the fluid flow pathway becomes operable when a pre-determined parameter is indicated in the well.

In some embodiments, the fluid flow pathway may be provided by providing the liner or casing with a flow device defined by a channel. The channel may be configured to permit fluid to flow from outside of the casing to an interior cavity of the casing, wherein the channel provides a fluid flow pathway from the first fracture zone to the adjacent fracture zone downhole from the first fracture zone.

In some embodiments, the flow device may be integrated into the liner or casing to form part of the liner or casing.

In some embodiments, the flow device may be configured for use with a fracturing system using a ball-valve activated sleeve or a dart-valve activated sleeve.

In some embodiments, the channel may include a blocking member configured to disengage from the channel when the pre-determined parameter is reached within the channel.

In some embodiments, the pre-determined parameter may be selected as a pressure indicating a screen-out condition and/or a pressure that will cause damage to the one or more downhole tools.

In some embodiments, the channel may further include a shield member which is pushed out of the channel when the blocking member is disengaged from the channel.

In some embodiments, the shield member may be formed of millable or dissolvable material.

In some embodiments, the flow device may be connected to an outer sidewall of the liner or casing.

In some embodiments, the flow device may be configured for use with a coiled tubing activated sleeve.

In some embodiments, the channel may include a blocking member configured to disengage from the channel when a pre-determined pressure is reached within the channel.

In some embodiments, the first fracture zone may be a plugged and perforated zone isolated by a set of fracturing plugs and the fluid flow pathway may be provided by remotely disengaging a lower fracturing plug of the set of fracturing plugs and allowing the lower fracturing plug to move in the downhole direction to extend a length of the first fracture zone until it encompasses an area of the adjacent fracture zone.

In accordance with another embodiment of the present disclosure, there is provided a flow device for generating fluid flow out of a first fracture zone of a well including a liner or casing to remove a screen-out condition and/or to protect one or more downhole tools deployed in the well. The device may include a main body defined by a channel, the channel may be configured to permit fluid to flow from outside of the liner or casing to an interior cavity of the liner or casing, wherein the channel provides a fluid flow pathway from the first fracture zone to the adjacent fracture zone downhole from the first fracture zone and a sub-casing configured to permit the sub-casing to form a part of the liner or casing.

The flow device may be configured for use with a fracturing system, a using ball-valve activated sleeve or a dart-valve activated sleeve.

In some embodiments of the flow device the channel may include a blocking member configured to disengage from the channel when a pre-determined parameter is reached within the channel.

In some embodiments of the flow device, the pre-determined parameter may be selected as a pressure indicating a screen-out condition and/or a pressure that will cause damage to the one or more downhole tools.

In some embodiments of the flow device, the channel may further include a shield member which is pushed out of the channel when the blocking member is disengaged from the channel.

In some embodiments of the flow device, the shield member may be formed of millable or dissolvable material.

In some embodiments of the flow device, the main body may be further defined by a fracturing channel providing a flow path to form a fracture or to treat a prior-formed fracture.

In some embodiments of the flow device, the flow device is configured for use with a coiled tubing activated sleeve.

In some embodiments of the flow device, the main body comprises an internal sliding sleeve configured to open and close the fracturing channel.

BRIEF DESCRIPTION OF THE DRAWINGS

In the Detailed Description section below, one or more embodiments of the present technology are described in relation to the attached figures. These embodiments are intended to provide a better understanding of the technology, how the technology may be put into practice, and to demonstrate certain advantages of the technology. The drawings are not necessarily to scale. Instead, emphasis is placed upon illustrating the principles of various embodiments of the invention. Similar reference numerals indicate similar components.

DETAILED DESCRIPTION

Introduction and Rationale

In screen-out conditions (also known as "pressure out" conditions) occurring during hydraulic fracturing, the fluid flow pathways into fractures become blocked by sand or other materials, generating a plug which causes excessive pressure to build in the isolated fracturing zone. This requires suspension of operations to prevent a catastrophic failure and such suspensions are undesirable due to associated costs.

If a screen-out occurs, the sand and slurry must be removed before fracturing operations can resume. Options for dealing with screen-outs may include (i) flowing the sand slurry back to surface using the energy of the fracture that was just pumped and the pressure of the reservoir (ii) stop the fracturing operation and clean out the well using a coiled tubing cleaning system, and (iii) if coiled tubing activated sleeves are used in the fracturing process, the sand slurry can be circulated out of the well to the surface. Implementation of any of these options cause unplanned work stoppages and can be detrimental to other components of the well such as downhole tools and well casing. For example, the cost in Canadian dollars to undertake the flow back process is in the range of $15,000 to $20,000, requiring at least about two hours. The clean out process may cost between about $400,000 to $500,000 with a delay of 2-4 days. If the clean out process is unsuccessful and fractured intervals below the screened-out zone remain incapable of producing hydrocarbons, losses can amount to more than $170,000 per interval.

An added complication is that a screen-out condition combined with high bottom-hole pressures can cause downhole fracturing sleeves and associated equipment to become damaged and prevent additional fractured zones from being properly stimulated or re-fractured, causing additional losses.

The present inventor has conceived of a solution for addressing the problem of screen-outs which is applicable to the four commonly used fracturing processes used in North America; (i) plug and perforate systems, (ii) systems using ball activated sleeves with seats where the sleeves are cemented or paired with open hole packers, (iii) systems using coiled tubing activated sleeves, and (iv) ball or dart activated sleeves without internal diameter restrictions.

The solution to the screen-out problem developed by the present inventor is to provide an engineered bypass mechanism triggered by well conditions such as pressure or triggered by remote actuation. Generation of a bypass or alternative flow path provides a new pathway for the sand or other material generating the plug to be pumped away from the blockage area and further downhole into another fracture, thereby enabling stimulation and production to continue.

Various embodiments of processes, systems and devices used to implement the subject technology are described below.

Figure 1A:
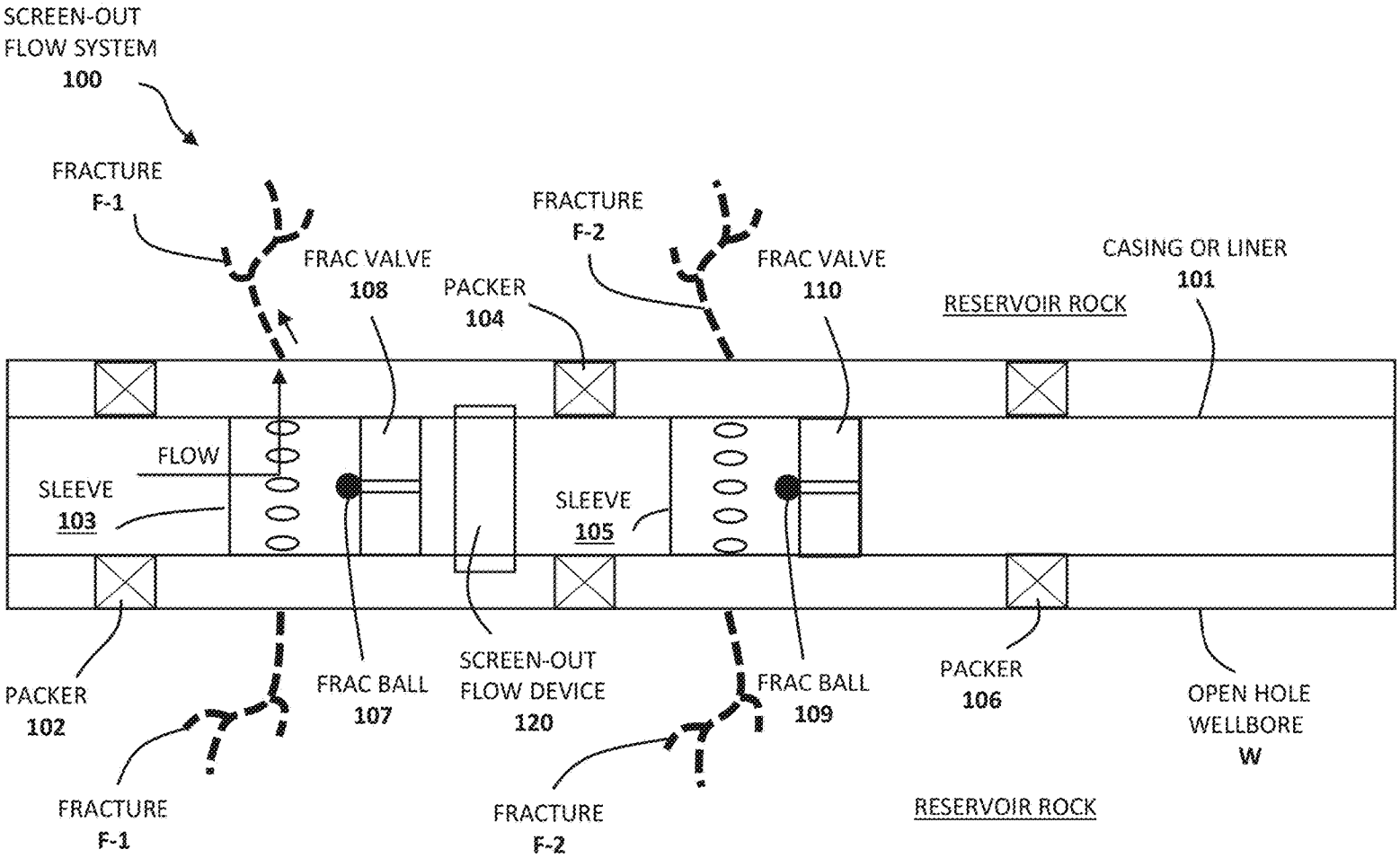
FIG. 1A is a schematic illustration of a cross-sectional view of one embodiment 100 of a screen-out flow system incorporating ball valve activated sleeves, indicating normal flow of fluid into a first fracture.
Figure 1B:
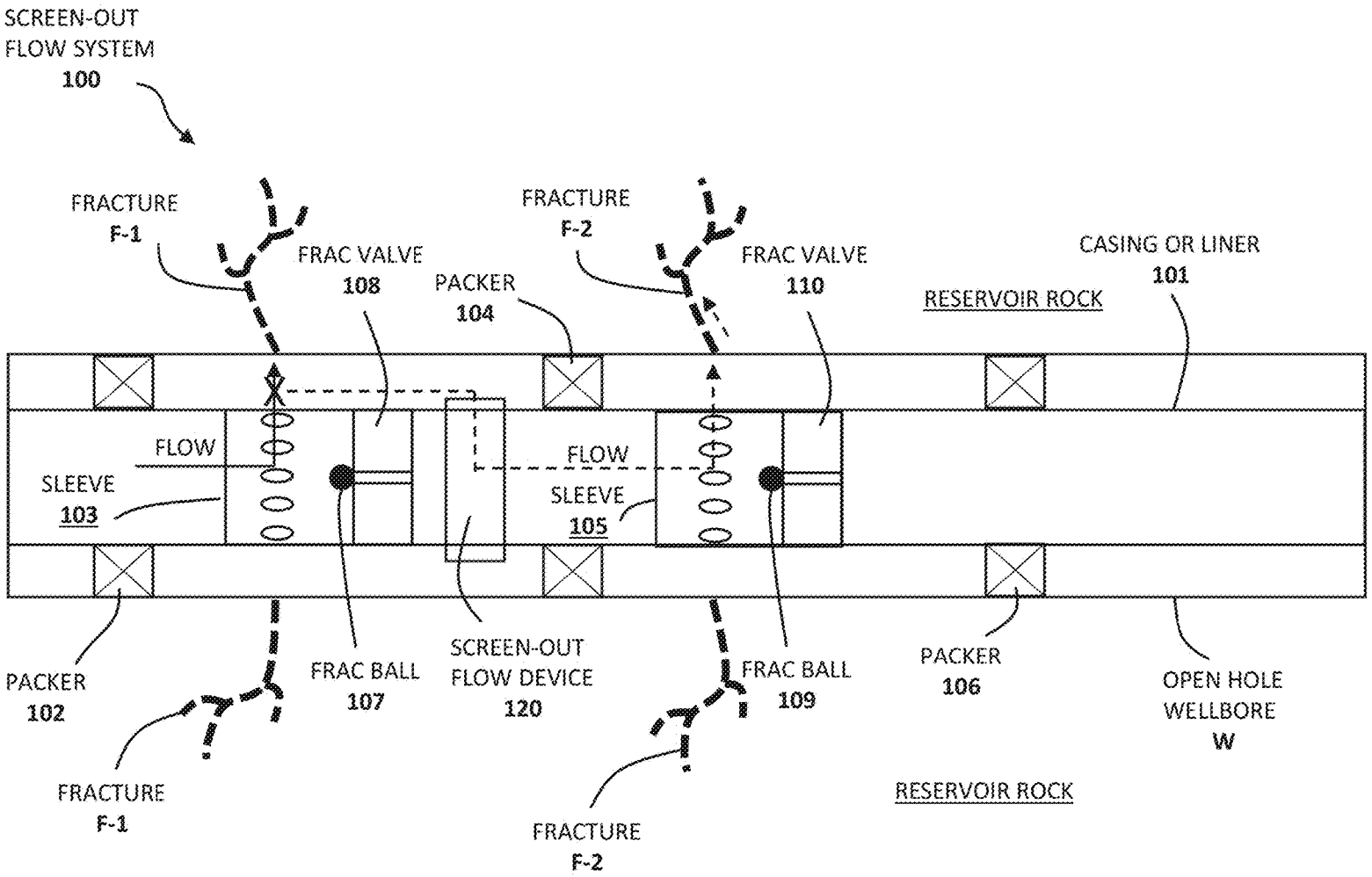
FIG. 1B is a schematic illustration of a cross-sectional view of embodiment 100 showing a bypass flow condition where fluid flow into the first fracture is blocked, causing flow into a second fracture via a bypass flow path.

Embodiment 1—Screen-Out Flow System Configured for Ball-Valve Activated Fracturing Sleeves An embodiment 100 of a screen-out flow system is illustrated in FIGS. 1A and 1B which is configured for use in combination with conventional ball-valve activated fracturing sleeves. FIG. 1A is a schematic illustration of this embodiment 100 showing normal flow of fluid through a ball valve activated fracturing sleeve 103 into a first fracture F-1, as would occur during a stimulation or re-fracturing process, for example. It is to be understood that other types of activatable fracturing sleeves such as dart valve activatable sleeves may be used in alternative embodiments using similar mechanistic principles. In FIG. 1A, a casing or liner 101 is located in an open hole wellbore W and two fracturing sleeves 103 and 105 are located within the casing or liner 101. Packers 102 and 104 define an isolated fracturing zone of fracture F-1 controlled by sleeve 103 which operates in conjunction with the isolating mechanism provided by frac ball 107 and valve seat 108. A screen-out flow device 120 is provided adjacent to frac valve 108 in the downhole direction within the sleeve 105 between packers 102 and 104. Sleeve 105 was previously used to generate a second fracture F-2 which is adjacent to the first fracture F-1 in the downhole direction. Another frac ball 109 and valve 110 is associated with sleeve 105 between packers 104 and 106.

It is seen in FIG. 1A that fluid flow for stimulation or re-fracturing moves in the direction of the solid arrow through the ports in sleeve 103 out of the casing or liner 101 and into the first fracture F-1 in the reservoir rock. Turning now to FIG. 1B, there is shown a situation where a screen-out condition has developed and flow into the first fracture F-1 is blocked as indicated by the "X" near the end of the solid arrow. Under this condition, the fluid flow remains constrained within the space between the casing or liner 101 and the sidewall of the well W between packers 102 and 104 due to isolation provided by the frac ball 107 seated on the valve seat 108. The screen-out flow device 120, which is located between packers 102 and 104 provides a bypass flow path back from the annulus into the casing or liner 101 via sleeve 105 as shown by the dashed arrows. This alternative bypass flow path permits the screen-out blockage or plug to be flushed away, removing the screen-out condition. The bypass flow path can be opened or activated in the screen-out flow device 120 by an engineered failure mechanism which automatically opens the flow path in response to a pre-determined pressure corresponding to a typical pressure developed by a screen-out condition, or alternatively, the bypass flow path can be provided in the screen-out flow device 120 by remote actuation such as an electromagnetic signal to open the flow path, if an operator observes a pressure in the isolated zone which is indicative of a screen-out condition, or a condition that would damage the casing or liner or downhole tools.

Figure 2A:
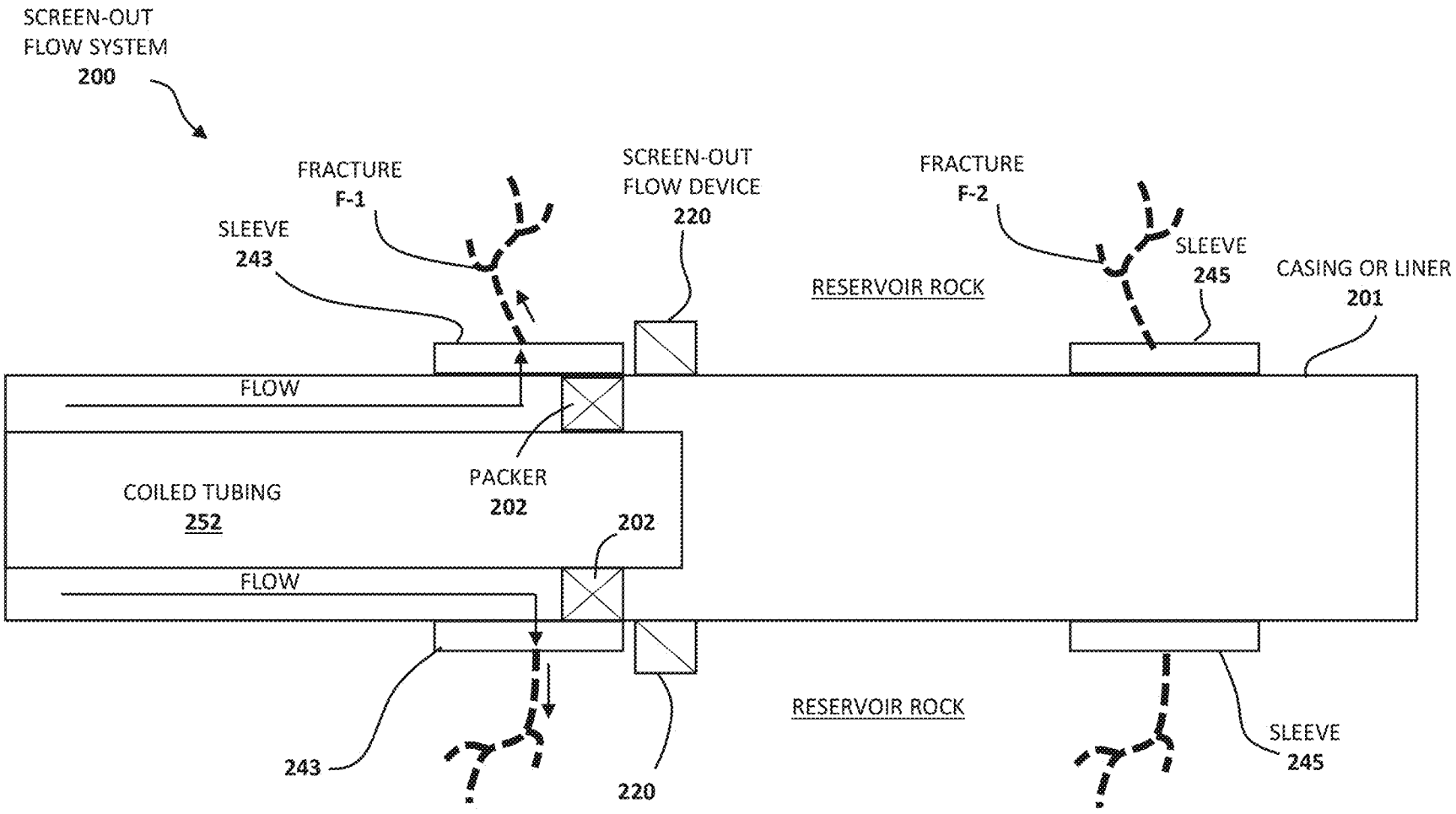
FIG. 2A is a schematic illustration of a cross-sectional view of another embodiment 200 of a screen-out flow system incorporating a coiled tubing activated sleeve, indicating a normal flow of fluid into a first fracture.
Figure 2B:
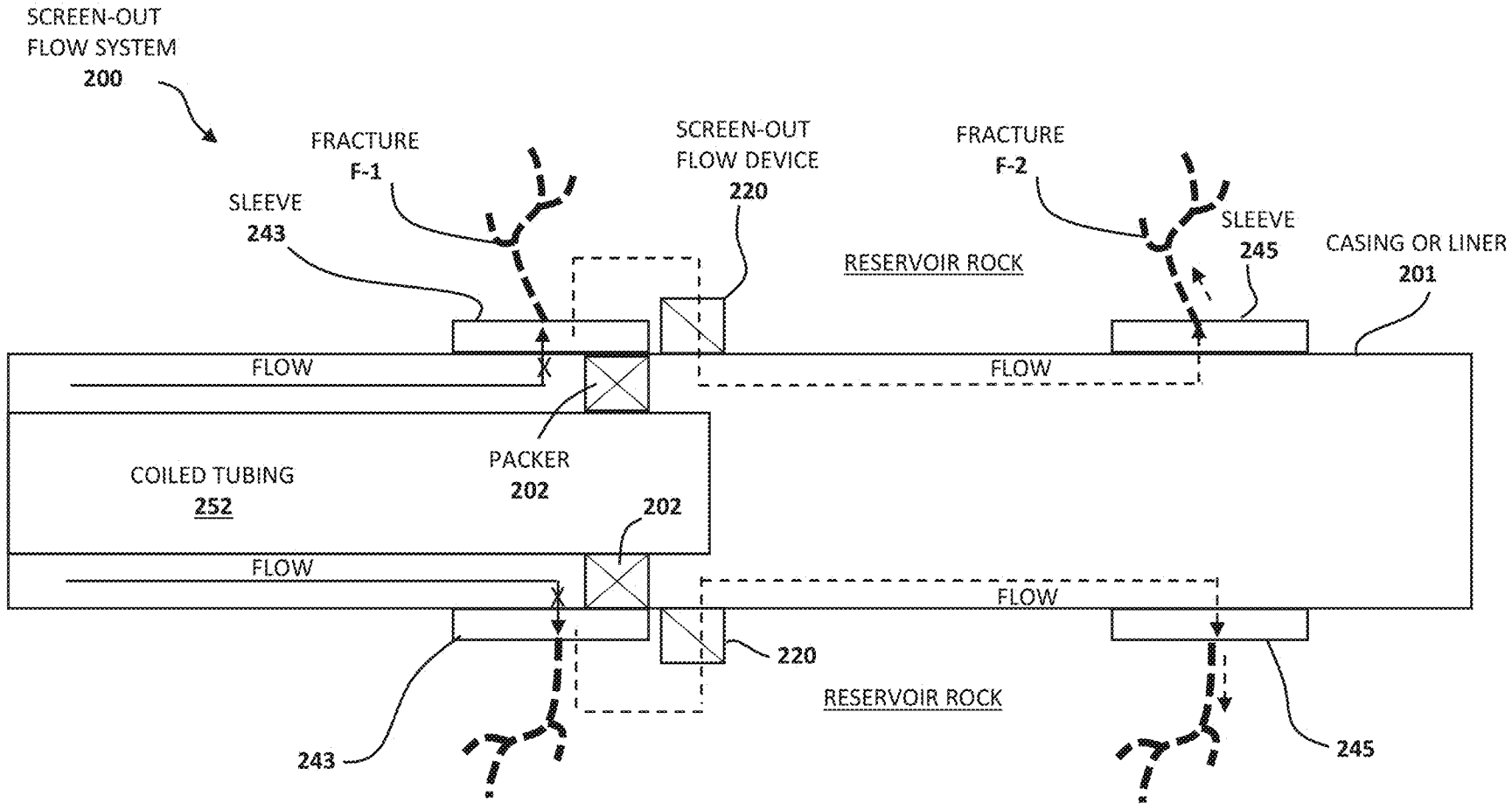
FIG. 2B is a schematic illustration of a cross-sectional view of embodiment 200 showing a bypass flow condition where fluid flow into the first fracture is blocked, causing flow into a second fracture via a bypass flow path.

Embodiment 2—Screen-out Flow System Configured for Coiled Tubing Activated Fracturing Sleeves An embodiment 200 of a screen-out flow system is illustrated in FIGS. 2A and 2B which is configured for use with coiled tubing activated fracturing sleeves. FIG. 2A is a schematic illustration of this embodiment 200 showing normal flow of fluid through a coiled tubing activated sleeve 243 in the space between the casing or liner 201 and the coiled tubing 252, into a first fracture F-1 in a zone isolated by packer 202. Also shown in this view is a second coiled tubing activated sleeve 245 which was previously used to generate the second fracture F-2. It is seen that the sleeves 243 and 245 are associated with the outer sidewall of the casing or liner 201 and permit fracture treatment fluid to be directed out of the casing or liner 201. A screen-out flow device 220 is also associated with the outer sidewall of the casing or liner 201.

Turning now to FIG. 2B, there is shown a situation where a screen-out condition has developed and flow into the first fracture F-1 is blocked as indicated by the "X" shown near the end of the solid arrow. Under this condition, the fluid flow remains constrained within the reservoir rock in the vicinity of the fracture F-1. The screen-out flow device 220, which is associated with the outer sidewall of the casing or liner 201, close to fracture F-1 and in the downhole direction from both the sleeve 243 and the packer 202, provides a flow path back into the casing or liner 201 as shown by the dashed arrows. This alternative bypass flow path permits the screen-out blockage or plug to be flushed away, removing the screen-out condition. The bypass flow path can be opened or activated in the screen-out flow device 220 by an engineered failure mechanism which automatically opens the flow path in response to a pre-determined pressure corresponding to a typical pressure developed by a screen-out condition, or alternatively, the bypass flow path can be provided in the screen-out flow device 220 by remote actuation such as an electromagnetic signal to open the flow path, if an operator observes a pressure in the isolated zone which is indicative of a screen-out condition.

Embodiment 3—A Screen-out Flow Device Configured for Integration into Casing

Figure 3A:
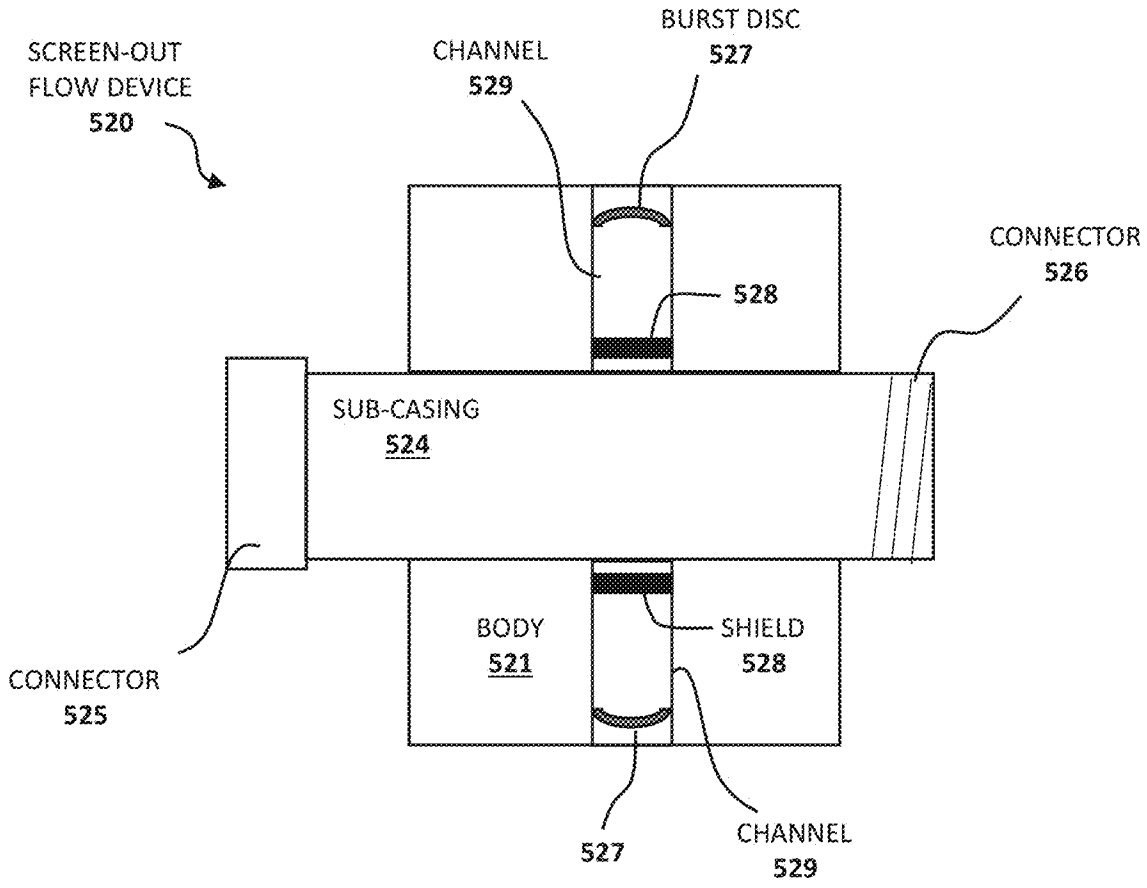
FIG. 3A is a schematic illustration of a cross-sectional view of a screen-out flow device 520.
Figure 3B:
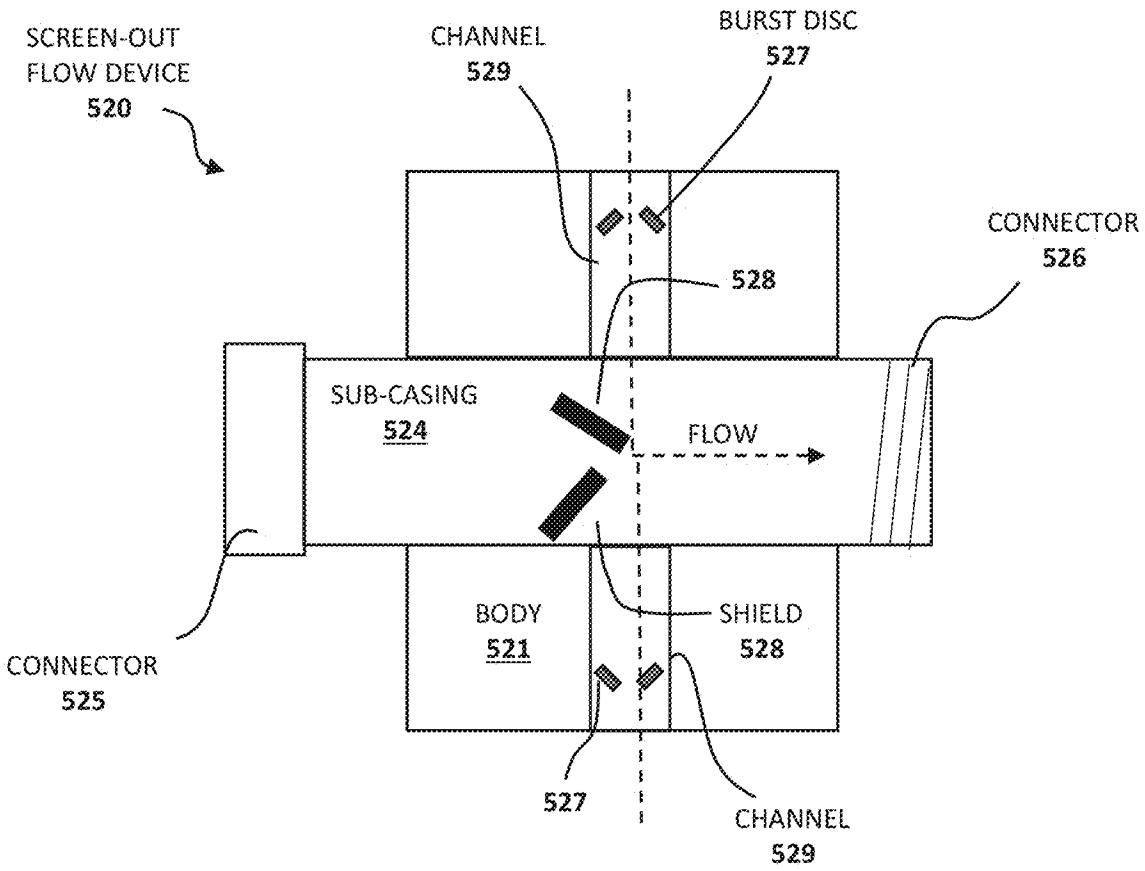
FIG. 3B is a schematic illustration of a cross-sectional view of a screen-out flow device 520 showing a bypass fluid flow condition where fluid flows from outside of the sub-casing 524 into the sub-casing 524 as a result of an upstream fracture being blocked.

FIGS. 3A and 3B illustrate an embodiment of a screen-out flow device 520 which is provided with an engineered failure mechanism to open a bypass flow path to address a screen-out condition. This device 520 is configured to be integrated into casing of a well subjected to hydraulic fracturing and includes a sub-casing component 524 which has connectors 525 and 526 provided for this purpose, such as conventional box and threaded connectors, for example. The main body 521 of the device surrounds the sub-casing 524 and includes a channel 529 in communication with the interior cavity of the sub-casing component 524. Channel 529 may be a circumferential channel which is concentric with the circumference of the sub-casing 524 or may be provided by a plurality of separate channels in alternative embodiments. Channel 529 holds a burst disc 527 and a shield 528. The purpose of burst disc 527 is to generally provide a barrier to entry of liquids or other materials into the casing of the well under normal operating conditions. The burst disc 527 is configured to rupture when a predetermined pressure is reached as shown in FIG. 3B, which in this embodiment is the pressure attained in an isolated fracture zone during a screen-out condition. In some embodiments, burst disc 527 is formed of materials such as metal, metal alloys and ceramics and engineered to rupture at a desired differential or absolute pressure. These pressures may range from about 10 MPa to about 100 MPa for example. As shown in FIG. 3B, rupture of the burst disc 527 permits fluid to flow back into the sub-casing 524 in the process of opening a new flow path to clear the sand and other material from an adjacent isolated fracturing zone, thereby removing the screen-out condition. The shield 528 is provided to protect the flow path and burst disc from pressure, contamination, and damage from pumping pressure, chemicals and sand which are pumped during fracturing operations. In some embodiments, the shield 528 is formed of materials such as conventional millable and dissolvable alloys which are used to construct other dissolvable components such as fracture plugs. The shield 528 is also pushed into the sub-casing following rupture of the burst disc 527. This fluid flow provides a means for clearing the material out of the previously isolated zone which is causing the screen-out condition.

Figure 4A:
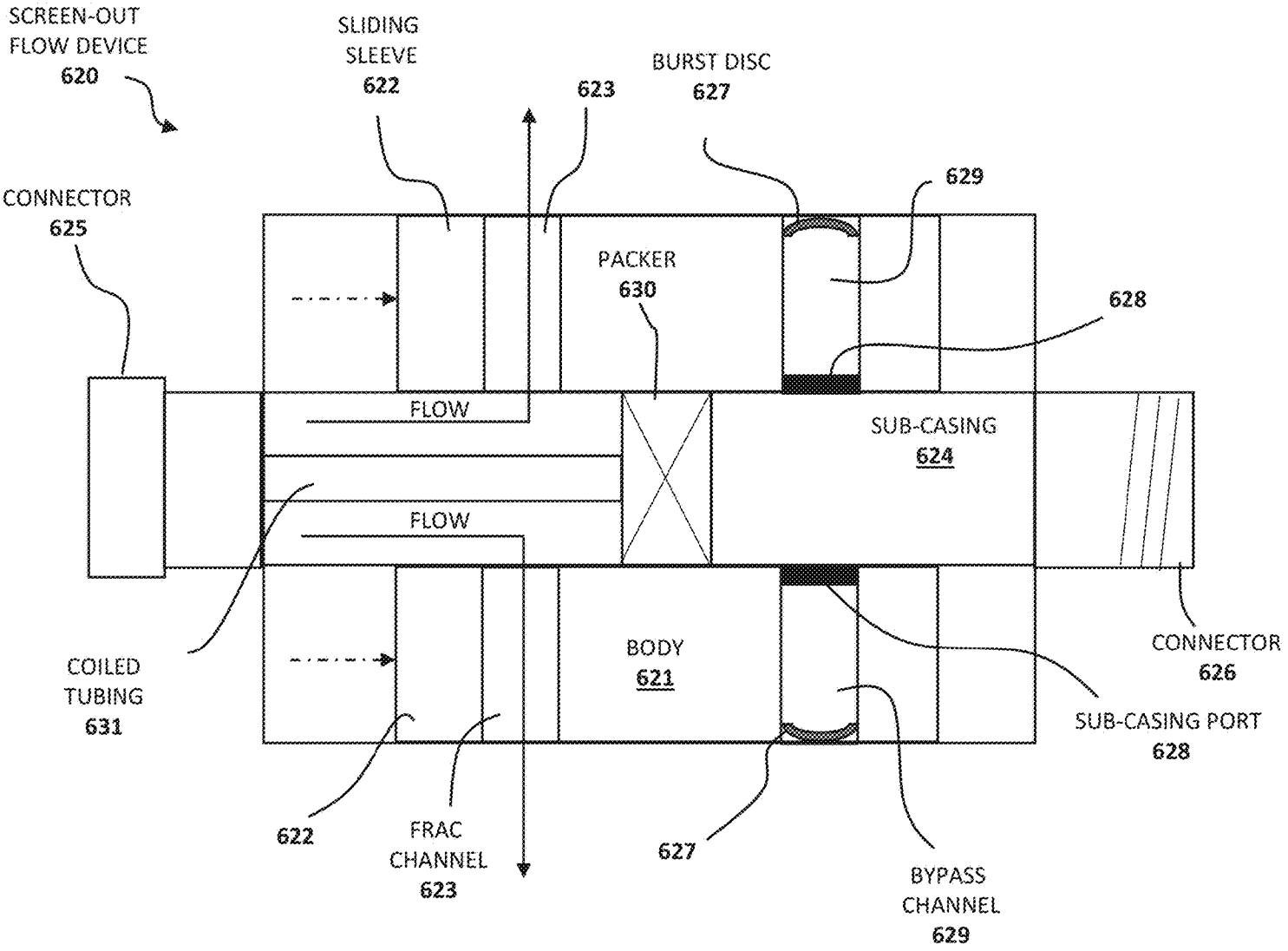
FIG. 4A is a schematic illustration of a cross-sectional view of another screen-out flow device 620 showing a direction of normal fluid flow through a frac channel 622 formed in the body 621 of the device 620.
Figure 4B:
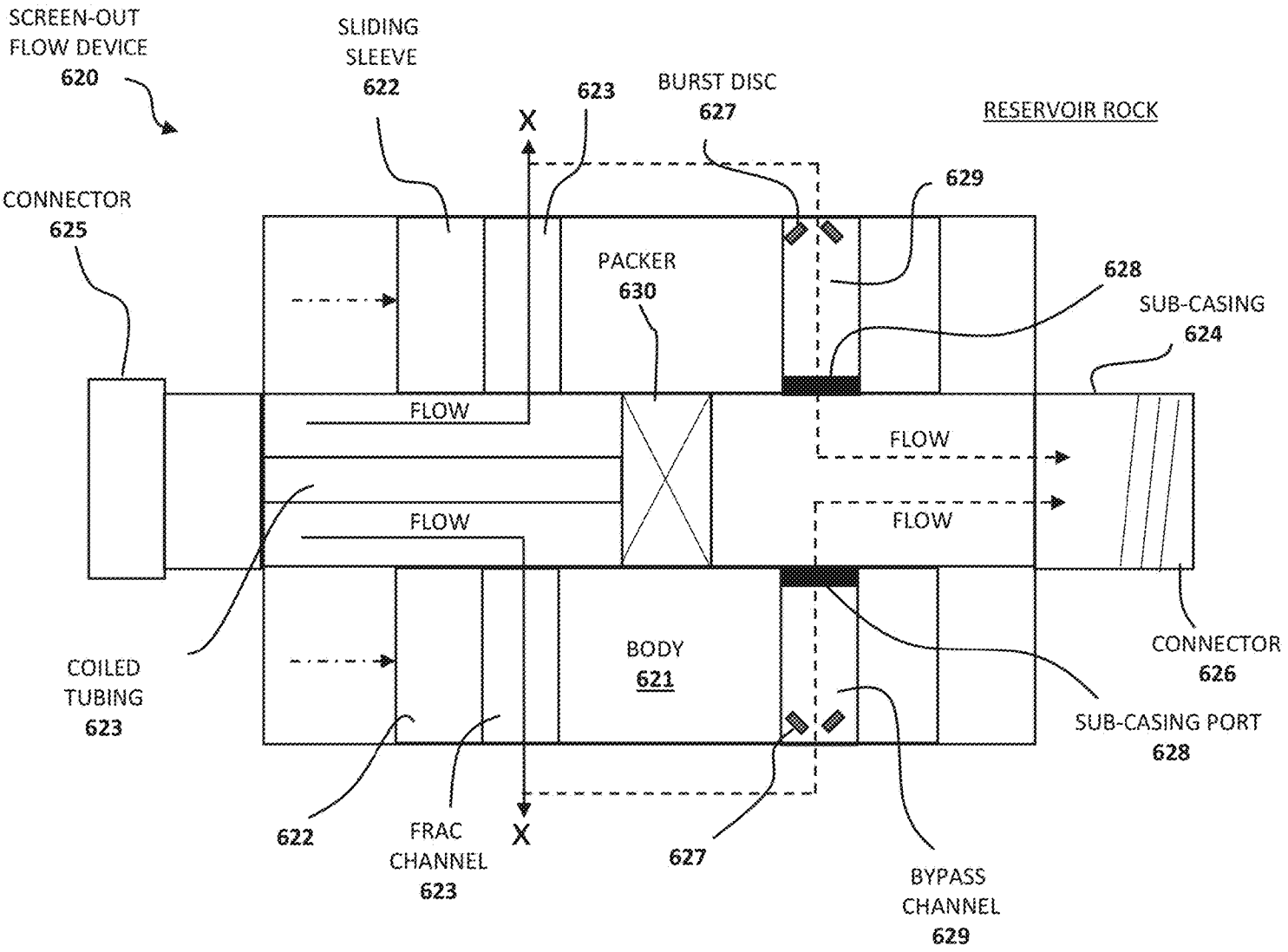
FIG. 4B is a schematic illustration of a cross-sectional view of screen-out flow device 620 showing a bypass fluid flow condition where fluid flows from outside of the device 620 into the device 620 via a bypass channel 629 formed in the body 621 of the device 620 as a result of an upstream fracture adjacent to the frac channel 622 being blocked.

Embodiment 4—A Screen-out Flow Device Configured for Integration into A Coiled Tubing-Associated Fracturing Sleeve FIGS. 4A and 4B illustrate an embodiment of a screen-out flow device 620 configured for integration into a coiled tubing fracturing sleeve. Device 620 is provided with an engineered failure mechanism to open a bypass flow path to address a screen-out condition. Device 620 includes a body 621 which is concentric with a sub-casing component 624 which itself is configured with connectors 625 and 626 provided for this purpose, such as conventional box and threaded connectors, for example. The main body 621 of device 620 surrounds the sub-casing 624 and includes a bypass channel 629 in communication with the interior cavity of the sub-casing component 624. Channel 629 may be a circumferential channel which is concentric with the circumference of the sub-casing 624 or may be provided by a plurality of separate channels in alternative embodiments. The bypass channel 629 holds a burst disc 627 and a sub-casing port 628 which is a hole in the sub-casing. When the sleeve 622 is shifted to the open position, the port 628 and the bypass channel 629 align. When sleeve 622 is in the closed position, the port and the bypass channel do not align and therefore give protection to the burst disc 627 and bypass channel 629. Burst disc 627 may be provided with features similar to that of burst disc 527 of device 520 described above.

The main body 621 includes a sliding internal sleeve 622 to provide alignment of the fracturing channel 623 with openings in the sleeve body 621 (the openings are not shown, to preserve clarity). The internal sleeve 622 slides in the direction of the dot-dashed arrows to provide this alignment.

FIG. 4A illustrates normal conditions of operation of screen-out flow device 620 with a packer 630 set by coiled tubing 631. The direction of treatment fluid flow is shown with the solid arrows extending from the cavity of the sub-casing 624 into the fracturing channels 623 for treatment of a fracture.

FIG. 4B illustrates fluid flow through device 620 during a screen-out condition where fluid flow into the fracture is blocked as indicated by the "X" near the end of the solid arrows. Under this condition, pressure builds outside of the body 621 until it reaches a threshold where it causes rupture of the burst disc 627, thereby permitting fluid to flow from the current packer 630 isolated zone back into the sub-casing 624 to the right of the packer 630 (in the orientation shown). This flow path provides a means for clearing the current fracture job material out of the once isolated zone which is causing the screen-out condition, and also allows the wellbore to be flushed so that it is free of any fracturing material.

Figure 5:
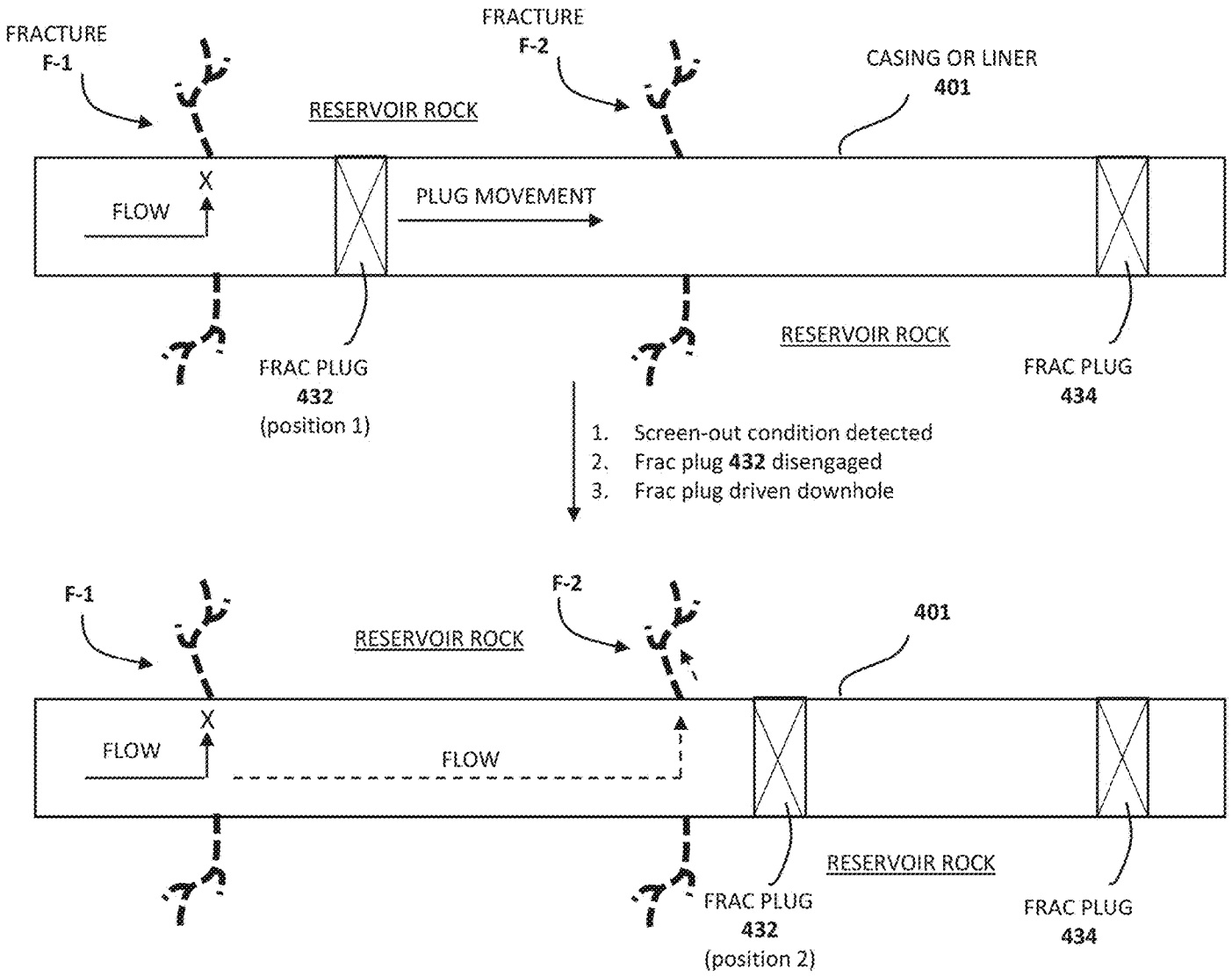
FIG. 5 is a schematic process flow diagram indicating how a frac plug 432 can be disengaged following detection of a screen-out condition and released to move past a second fracture to open a new fluid flow path.

Embodiment 5—Process for Generating Flow in a Screened-out Fracture Zone in a Plug and Perforate Fracture System One embodiment of a process for generating flow in a screened-out fracture zone generated in a plug and perforate system is illustrated in FIG. 5. The system includes casing or liner 401 and frac plugs 432 and 434 for isolating the fracturing zones with a first fracture zone located to the left of frac plug 432 and a second fracture zone located between frac plug 432 and frac plug 434. In this process, the first fracture zone which includes first fracture F-1 is experiencing a screen-out condition as indicated by the "X" at the end of the solid arrow. This condition is detected by surface monitoring of pressure in the first fracture zone. Upon detection of the screen-out condition, frac plug 432 is remotely disengaged by means of radio or EMF signal. Integral to the frac plug may be a receiving device, an energy source, and a motorized mechanism that has the potential to trigger a cascading failure mechanism that compromises the ability for the frac plug to stay attached to the casing or liner 401. As a result of the pressure in the screened-out zone, and the engineered failure mechanism in the frac plug 432, the plug 432 is driven in the downhole direction away from its original position (position 1) as shown by the solid arrow until it moves past the second fracture F-2 and reaches position 2. This opens a new pathway for release of pressure and flow of fluids into the second fracture F-2. With this expanded flow of fluids, the material causing the screen-out condition is flushed away from the first fracture F-1 leaving the wellbore flushed and clean to continue completion operations or to set the well to flowback and production.

EQUIVALENTS AND SCOPE

Other than described herein, or unless otherwise expressly specified, all numerical ranges, amounts, values and percentages, such as those for amounts of materials, elemental contents, times and current rate, ratios of amounts, and others, in the following portion of the specification and attached claims may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained. At the very least, each numerical parameter should at least be construed in light of the number of reported significant digits and by applying ordinary rounding techniques.

The terms "approximately," "about," "substantially," and similar terms are intended to have a broad meaning in harmony with the common and accepted usage by those of ordinary skill in the art to which the subject matter of this disclosure pertains. It should be understood by those of skill in the art that these terms are intended to allow a description of certain features described and claimed without restricting the scope of these features to the precise numeral ranges provided. Accordingly, these terms should be interpreted as indicating that insubstantial or inconsequential modifications or alterations of the subject matter described and are considered to be within the scope of the disclosure.

The articles "the", "a" and "an" are not necessarily limited to mean only one, but rather are inclusive and open ended so as to include, optionally, multiple such elements.

"At least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, to at least one, optionally including more than one, A, with no B present (and optionally including entities other than B); to at least one, optionally including more than one, B, with no A present (and optionally including entities other than A); to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

Where two or more ranges are used, such as but not limited to 1 to 5 or 2 to 4, any number between or inclusive of these ranges is implied.

As used herein, the phrase, "for example," the phrase, "as an example," and/or simply the term "example," when used with reference to one or more components, features, details, structures, and/or methods according to the present disclosure, are intended to convey that the described component, feature, detail, structure, and/or method is an illustrative, non-exclusive example of components, features, details, structures, and/or methods according to the present disclosure. Thus, the described component, feature, detail, structure, and/or method is not intended to be limiting, required, or exclusive/exhaustive; and other components, features, details, structures, and/or methods, including structurally and/or functionally similar and/or equivalent components, features, details, structures, and/or methods, are also within the scope of the present disclosure.

The term "comprising" is intended to be open and permits but does not require the inclusion of additional elements or steps. When the term "comprising" is used herein, the term "consisting of" is thus also encompassed and disclosed. Where ranges are given, endpoints are included. Furthermore, it is to be understood that unless otherwise indicated or otherwise evident from the context and understanding of one of ordinary skill in the art, values that are expressed as ranges can assume any specific value or subrange within the stated ranges in different embodiments, to the tenth of the unit of the lower limit of the range, unless the context clearly dictates otherwise. Where the term "about" is used, it is understood to reflect +/−10% of the recited value. In addition, it is to be understood that any particular embodiment that falls within the prior art may be explicitly excluded from any one or more of the claims. Since such embodiments are deemed to be known to one of ordinary skill in the art, they may be excluded even if the exclusion is not set forth explicitly herein.

In addition, it is to be understood that any particular embodiment of the present disclosure that falls within the prior art may be explicitly excluded from any one or more of the claims. Since such embodiments are deemed to be known to those of ordinary skill in the art, they may be excluded even if the exclusion is not set forth explicitly herein. Any particular embodiments of compositions disclosed herein can be excluded from any one or more claims, for any reason, whether or not related to the existence of prior art.

All cited sources, for example, references, publications, databases, database entries, and art cited herein, are incorporated into this application by reference, even if not expressly stated in the citation. In case of conflicting statements of a cited source and the instant application, the statement in the instant application shall control.

The invention claimed is:

1. A process for generating fluid flow out of a first fracture zone of a well including a liner or casing to remove a screen-out condition and/or to protect one or more downhole tools deployed in the well, the process comprising:

providing the casing with a permanent or temporary fluid flow pathway extending from a first fracture zone to an adjacent fracture zone downhole from the first fracture zone, wherein the fluid flow pathway becomes operable when a pre-determined parameter is indicated in the well, wherein the permanent or temporary fluid flow pathway is provided by providing the liner or casing with a flow device defined by a channel, the channel configured to permit fluid to flow from outside of the casing to an interior cavity of the casing, wherein the channel provides the permanent or temporary fluid flow pathway from the first fracture zone to the adjacent fracture zone downhole from the first fracture zone, wherein the flow device is integrated into the liner or casing to form part of the liner or casing, and wherein the flow device is configured for use with a fracturing system using a ball-valve activated sleeve or a dart-valve activated sleeve.

2. The process of claim 1, wherein the channel comprises a blocking member configured to disengage from the channel when the pre-determined parameter is reached within the channel.

3. The process of claim 2, wherein the pre-determined parameter is selected as a pressure indicating a screen-out condition and/or a pressure that will cause damage to the one or more downhole tools.

4. The process of claim 3, wherein the channel further comprises a shield member which is pushed out of the channel when the blocking member is disengaged from the channel.

5. The process of claim 4, wherein the shield member is formed of millable or dissolvable material.

6. The process of claim 1, wherein the flow device is connected to an outer sidewall of the liner or casing.

7. The process of claim 1, wherein the first fracture zone is a plugged and perforated zone isolated by a set of fracturing plugs and the fluid flow pathway is provided by remotely disengaging a lower fracturing plug of the set of fracturing plugs and allowing the lower fracturing plug to move in the downhole direction to extend a length of the first fracture zone until it encompasses an area of the adjacent fracture zone.

8. A flow device for generating fluid flow out of a first fracture zone of a well including a liner or casing to remove a screen-out condition and/or to protect one or more downhole tools deployed in the well, the device comprising:

a main body defined by a channel, the channel configured to permit fluid to flow from outside of the liner or casing to an interior cavity of the liner or casing, wherein the channel provides a fluid flow pathway from the first fracture zone to the adjacent fracture zone downhole from the first fracture zone; and a sub-casing configured to permit the sub-casing to form a part of the liner or casing, wherein the flow device is configured for use with a fracturing system using a ball-valve activated sleeve or a dart-valve activated sleeve.

9. The flow device of claim 8, wherein the channel comprises a blocking member configured to disengage from the channel when a pre-determined parameter is reached within the channel.

10. The flow device of claim 9, wherein the pre-determined parameter is selected as a pressure indicating a screen-out condition and/or a pressure that will cause damage to the one or more downhole tools.

11. The flow device of claim 10, wherein the channel further comprises a shield member which is pushed out of the channel when the blocking member is disengaged from the channel.

12. The flow device of claim 11, wherein the shield member is formed of millable or dissolvable material.

13. The flow device of claim 9, wherein the main body is further defined by a fracturing channel providing a flow path to form a fracture or to treat a prior-formed fracture.

14. A flow device for generating fluid flow out of a first fracture zone of a well including a liner or casing to remove a screen-out condition and/or to protect one or more downhole tools deployed in the well, the device comprising:

a main body defined by a channel, the channel configured to permit fluid to flow from outside of the liner or casing to an interior cavity of the liner or casing, wherein the channel provides a fluid flow pathway from the first fracture zone to the adjacent fracture zone downhole from the first fracture zone; and a sub-casing configured to permit the sub-casing to form a part of the liner or casing, wherein the flow device is configured for use with a coiled tubing activated sleeve.

15. The flow device of claim 14, wherein the main body comprises an internal sliding sleeve configured to open and close the fracturing channel.

16. The flow device of claim 14, wherein the channel comprises a blocking member configured to disengage from the channel when a pre-determined parameter is reached within the channel.

17. The flow device of claim 16, wherein the pre-determined parameter is selected as a pressure indicating a screen-out condition and/or a pressure that will cause damage to the one or more downhole tools.

18. The flow device of claim 17, wherein the channel further comprises a shield member which is pushed out of the channel when the blocking member is disengaged from the channel.

19. The flow device of claim 18, wherein the shield member is formed of millable or dissolvable material.

20. The flow device of claim 14, wherein the main body is further defined by a fracturing channel providing a flow path to form a fracture or to treat a prior-formed fracture.

* * * * *